United States Patent [19]

Vadala'

[11] Patent Number: 4,597,238

[45] Date of Patent: Jul. 1, 1986

[54] HIGHLY INSULATING BRICK FOR MASONRY

[76] Inventor: Giuseppe Vadala', Via Giovanni XXIII, 4-87100 Roggiano Gravina, Italy

[21] Appl. No.: 668,232

[22] Filed: Nov. 5, 1984

[51] Int. Cl.[4] ..... E04B 1/78

[52] U.S. Cl. ..... 52/606; 52/98; 52/DIG. 2; D25/80; D25/90

[58] Field of Search ..... 52/439, 98, 100, 596, 52/606, 607, 608, DIG. 2; D25/80, 87, 88, 89, 90, 91, 92, 97

[56] References Cited

U.S. PATENT DOCUMENTS

| | | | |
|---|---|---|---|
| 760,059 | 5/1904 | Dolley | D25/90 X |
| 1,683,441 | 9/1928 | Bone | 52/606 X |
| 1,720,306 | 7/1929 | Tremper | 52/606 |
| 1,727,362 | 9/1929 | Bone | 52/98 X |
| 1,945,681 | 2/1934 | Farrens | 52/606 |
| 2,833,532 | 5/1958 | Ries | 52/606 X |

FOREIGN PATENT DOCUMENTS

| | | | |
|---|---|---|---|
| 276706 | 12/1969 | Australia | 52/606 |
| 2226460 | 12/1973 | Fed. Rep. of Germany | 52/606 |
| 2640064 | 3/1977 | Fed. Rep. of Germany | 52/606 |
| 32265 | 11/1927 | France | 52/DIG. 2 |
| 2454489 | 12/1980 | France | 52/606 |
| 556564 | 2/1957 | Italy | 52/606 |

OTHER PUBLICATIONS

"Concrete Masonry Pictorial", vol. 15, No. 2, Nov. 1959, pp. 20,21.

*Primary Examiner*—John E. Murtagh
*Assistant Examiner*—Richard E. Chilcot, Jr.
*Attorney, Agent, or Firm*—Townsend and Townsend

[57] ABSTRACT

The brick consists of one or more sub-blocks. Each sub-block is divided into air chambers of contained width but extensive in length. The walls which divide each sub-block into chambers are shaped as alternatively concave and convex arcs of a circle. The chambers are connected by first septa of minimum length. The sub-blocks are connected by second septa also of minimum length and spaced apart from the periphery of the brick and placed so as not to align with the ends of the arc walls.

Thermal bridges between the inside and outside of a wall are thus almost completely eliminated, with a brick light in weight, very strong and low in cost.

5 Claims, 4 Drawing Figures

HIGHLY INSULATING BRICK FOR MASONRY

FIELD OF THE INVENTION

The invention concerns a brick preferably made of clay for use in construction in reinforced concrete and in traditional masonry with a decisive heat insulating function, light in weight, very strong, and low in cost, to be used as a self-supporting and/or sealing and/or partitioning element.

BACKGROUND OF THE INVENTION

In residential as well as industrial construction the structure is commonly enclosed by means of two brick walls placed at a certain distance from one another forming an air space. The space between the two walls is filled with an insulating material. This procedure involves very high labor costs in the construction of the two parallel walls a certain distance apart, as well as very high costs for the necessary insulating material. Moreover, the insulating material sublimes over time, that is it becomes depleted, reducing the function of the air space until it is eliminated, and with it the function of providing good insulation.

It is known that to reduce the weight and improve the insulation of a construction brick, the raw material mixture, for exmple of clay, is treated with combustible organic materials like sawdust, peat, cork, coal dust and the like. When the bricks are fired, these materials are released in gaseous form giving rise inside the brick to an alveolar configuration which has the due effect of improving insulation and lightening the brick. However, these combustible organic materials cannot be added to the mixture beyond a certain degree since increasing the quantity considerably decreases the moldability of the mixture due to the relatively high friction of said materials. Furthermore, increasing the quantity of organic material incorporated, greatly lowers the pressure resistance since the incorporated material impedes the natural contraction of the raw material during drying. This leads to cracks which propagate because of the above mentioned friction of the incorporated material. Thus, increasing the quantity of material placed in the mixture widens the cracks so much the strength of the product is seriously reduced.

In order to overcome these problems and obtain a porous, insulating and light, but high strength brick or block, Italian Pat. No. 605,312 proposes incorporating in the raw material (clay, kaolin, clay schists and the like) a compressible material synthetic in nature, molding the resulting mixture to form the final product, drying it, and finally firing it. Since the incorporated material can be compressed to a smaller volume, it does not prevent contraction of the raw material during drying. Crack formation is thus substantially reduced or even eliminated, and the compression strength of the product is not compromised. The systhetic compressible material is placed in the mixture in the form of pieces made to swell or foam, preferably in the form of small beads. For the material to be incorporated, Italian Pat. No. 605,312 proposes a synthetic material like polystyrene, phenol-plastics, polyvinyl synthetics like polyvinyl chloride, or polyesters, formaldehyde urea, polyurethane, polyethylene, polyisobutylene, latex rubber, silica and cellulose derivatives like cellulose acetate.

A brick as described has been marked under the name "Poroton". It is rectangular in shape and subdivided by means of partitions, running along its width into several chambers parallel to one another and connected by several partitions orthogonal to the former, so as to form an actual lattice. The periphery of the brick, like all its partition, has an alveolar structure, as described below, in order to reduce weight and allow good insulation. Such a brick responds in effect, both in terms of cell-like structure and of the percent of openings (maximum 45%), that is of the empty spaces created in the chambers formed by the partitions and the cell-like structure, to the properties listed for bricks prepared with cell-like structure using compressible organic materials. However, it should be noted that the insulation is a function only of the cell-like structure and that to obtain said structure, one must use synthetic compressible material whose cost is not negligible. On the other hand, the quantity of said material may not, even in this type of brick, exceed a certain amount, to prevent excessive weakening of the brick itself.

In this regard, it should be noted that heat is transferred by radiation, convenction and conduction. Transmission by radiation is considered to be negligible, and so it will not be considered. Transmission by air convection occurs vertically toward the ceiling; the quantity of heat which the air can transmit horizontally toward the outside, or vice versa, is negligible when the chambers are developed vertically, with as little horizontal development as possible. Transmission by conduction occurs through solid bodies (clay, in the present case) horizontally. Therefore, the insulation of a brick is enhanced by reducing the possibility of heat diffusion by conduction to a minimum. In the brick in question, however, the various chambers are connected to one another, from the inside toward the outside, by several septa which form several actual heat bridges, which facilitate heat transmission by conduction in this direction with a result of cancelling the effect of the chamber presence, and reducing the insulating effect which could have been achieved by the cell-like structure.

The insulating effect of the latter structure however is a function of the greater or lesser regularity of the mixing of the additive with the clay. This obviously leads to the manufacture of bricks with different insulating capacities. The aim of this invention is thus to overcome the inconveniences mentioned above by proposing a lightweight but still very strong brick, with low production costs and, above all, enhanced insulation.

SUMMARY OF THE INVENTION

The invention achieves this by providing a brick, preferably of clay, characterized by the fact that:

said brick consists of one or more sub-bricks;

each sub-brick has a rectangular peripheral outline and is subdivided by means of walls into vertical air chambers, limited in the direction of the longitudinal axis and extensive in the direction of its transverse axis;

said walls forms cores shaped like the arcs of a circle arranged alternatively concave and convex along the longitudinal direction of the brick;

the line connecting centers of curvature of said circles form lines parallel to the longitudinal axis of the brick;

the widths of each chamber along the longitudinal direction forming alternately longer and shorter line segments from one chamber to the next;

the convex sides of the arcs are connected to one another by rectilinear septa of minimum length, and the sub-blocks are connected to one another by rectilinear septa, also of minimum length, spaced apart from the peripheral outline of the brick, and placed so as not to align with the ends of the arc walls. The fundmental concept of the invention thus resides in the structural geometry with which heat transmission bridges have been substantially eliminated, by limiting the connections between sub-blocks to septa of minimum length, in any case never placed in line with the walls of the cores placed in the same direction, and by reducing to a minimum the contact surface between the convex walls of the chambers. Since the air chambers in each sub-block must extend as much as possible in the direction of its transverse axis, the curving walls are of long radius and, consequently, their contact surfaces are reduced to the minimum. Therefore, the invention includes connection between the walls by means of septa which may be very short since they connect opposite convex walls.

According to the invention, the brick is realized preferably in clay, with no use of cell-like material. If a further lightening of the block is desired, already per se enhanced by the high percentage of openings due to the chambers with circular outlines, the invention proposes as cell-forming material the final residue in the preparation of sansa oil, the cost of which is almost negligible, as can be imagined.

The structural geometry also enhances acoustic inertia. In fact, the vibratory energy hitting the exposed wall should then emanate from longer walls over always different distances, since a rectilinear wall is always opposite a curved wall, and a concave curved wall is always opposite a convex one.

Finally, it should be observed that, according to the invention, the structural geometry consists of arcs and segments of a circle arranged so as to absorb compression loads in an optimal manner. In fact, the resultants of all the forces acting on the arcs of the sub-block are distributed along the arcs depending on their height, and the connecting septa between the opposite convex walls of the individual chambers are placed in the points where the arcs break. The brick according to the invention can be used as a conventional brick to construct masonry having a desired height and length.

BRIEF DESCRIPTION OF THE DRAWINGS

The object of the invention will be described below with reference to preferred embodiments shown by an exemplary and non-limiting way in the attached drawings, in which.

DETAILED DESCRIPTION OF THE DRAWINGS

Figure 1:
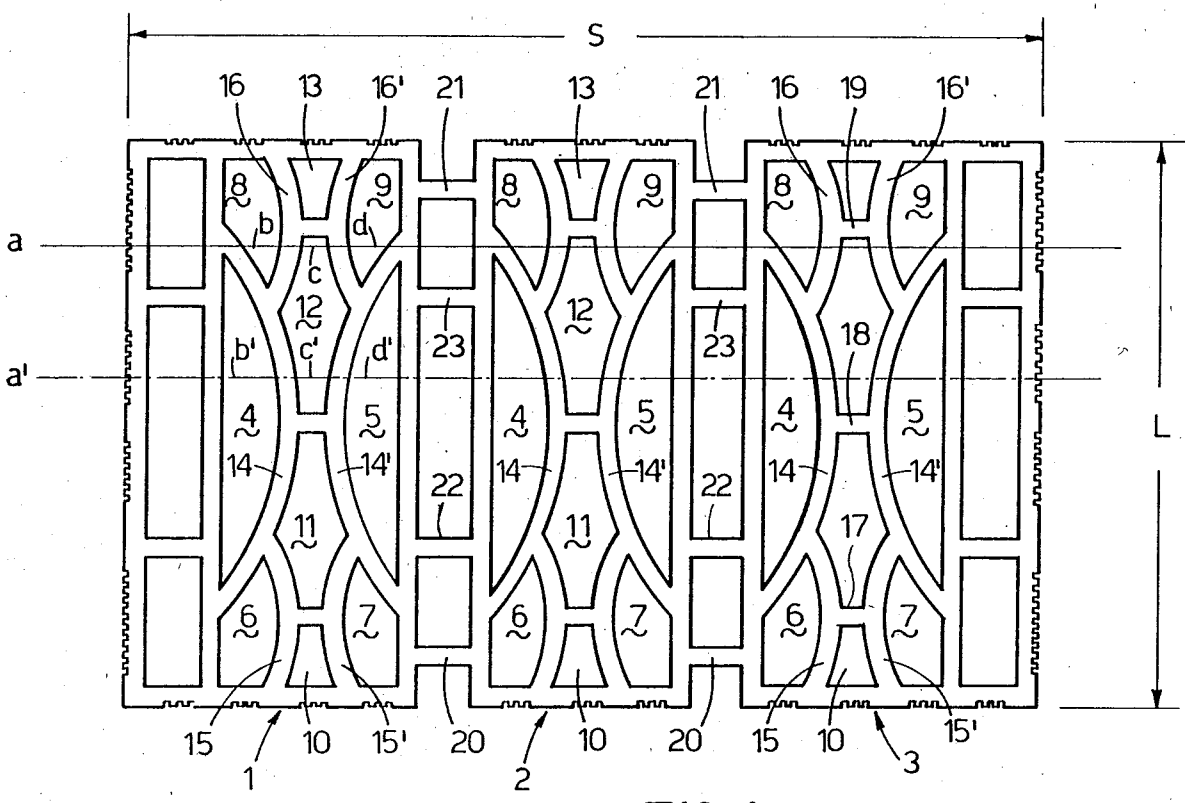
FIG. 1 is a plan view of a first embodiment of a brick according to the invention consisting of three sub-blocks.

In FIG. 1 a first embodiment of the brick according to the invention consists in the present case of three sub-bricks generally indicated as 1, 2, 3, where S indicates the width, L the length and H the height. One notes immediately that the air chambers are represented by the spaces 4–13 between arched walls 14, 14'; 15, 15'; 16, 16' arranged with concave and convex shapes opposite to one another in groups of two, and that, again in groups of two, the centers of curvature of the arcs are aligned along a single line parallel to the longitudinal axis of the brick. The connecting septa 17, 18, 19 between the chambers 4, 5; 6,7; 8, 9 are of minimum length since they connect the chambers between two convex points in their walls. Chambers 4–13 are all not very wide in the direction of the longitudinal axis of the brick, while they extend in height, that is, in the direction of the transverse axis of the brick.

For any line a parallel to the longitudinal axis of the brick, one notes how, moving it always in a parallel fashion, for example to position a' the chambers of the sub-bricks always have in this direction widths b, c, d; b', c', d', which are larger and smaller in alternate succession.

Finally, one notes how the septa 20, 21 connecting sub-blocks 1, 2, 3 to one another are shifted toward the inside of the brick. This is done to interrupt the continuity of the thermal bridge along one external core from one sub-block to the other. The connecting septa 22, 23 are also neither aligned nor in contact directly with the walls of the inner cores in the same direction, to prevent conduction of heat, which is dispersed on the walls vertically.

Figure 3:
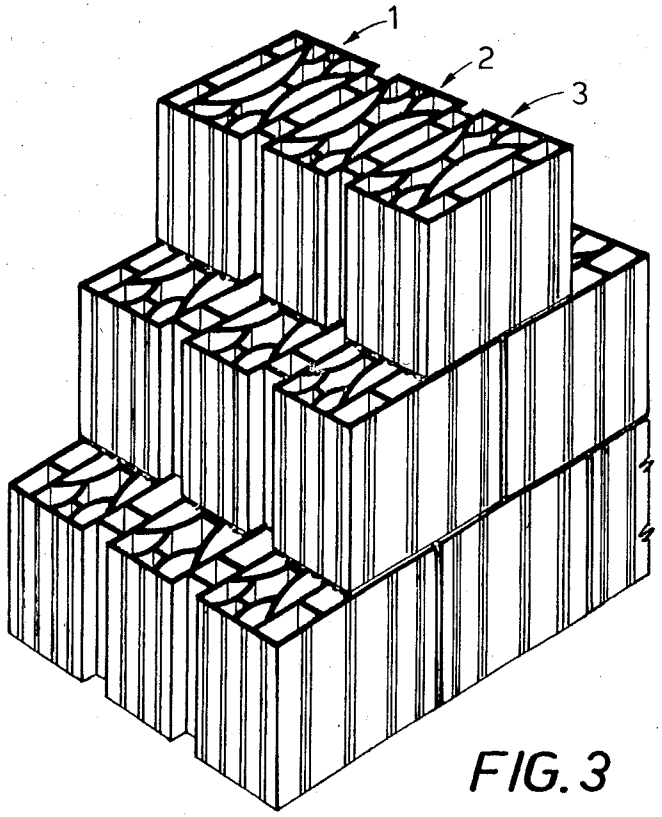
FIG. 3 is an axonometric view analogous to that of FIG. 2 with bricks laid with its openings on a horizontal plane.
Figure 2:
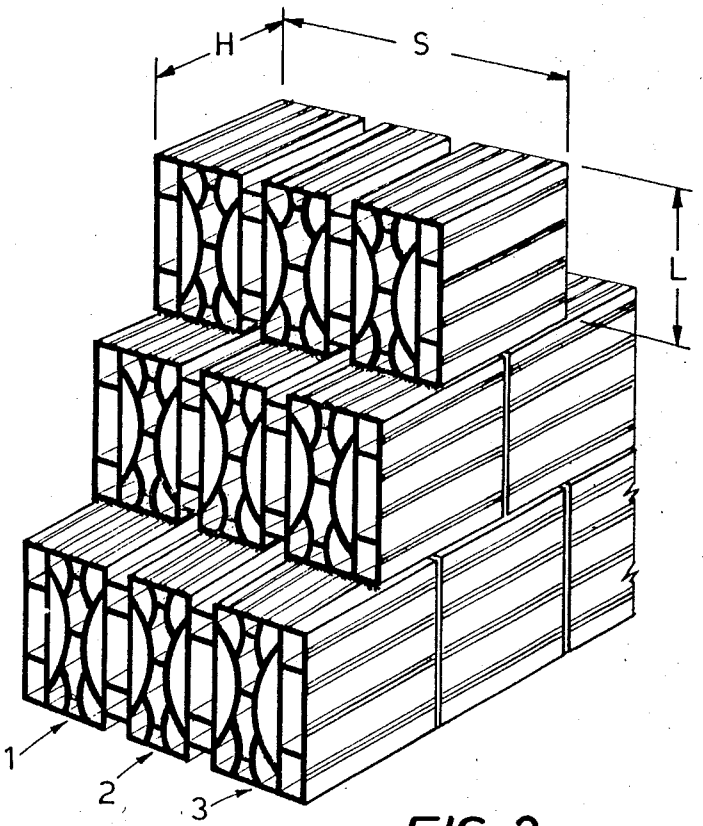
FIG. 2 is an axonometric view of bricks of FIG. 1 laid with its openings on a vertical plane.
Figure 4:
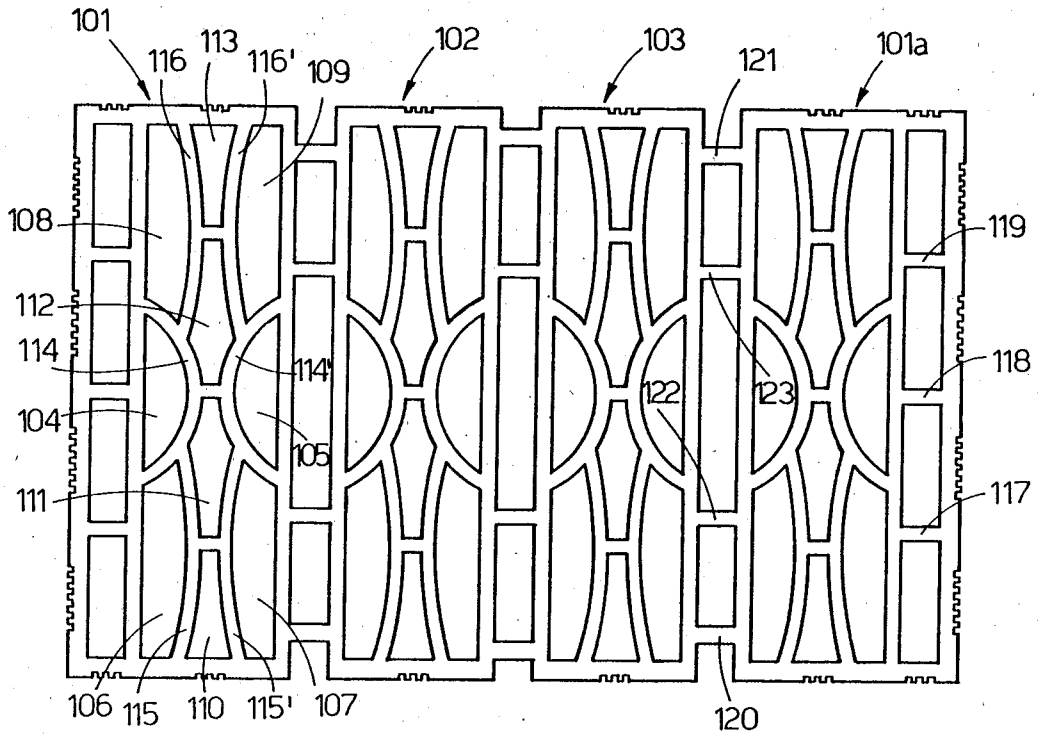
FIG. 4 is a plan view of a second embodiment of a brick according to the invention consisting of four sub-blocks.

The bricks may be laid both with the openings in horizontal planes and overlapping, and with the openings in vertical planes and side by side, as shown more clearly in FIGS. 2 and 3;

In FIG. 4, in which numbers increased by one hundred with respect to FIG. 1 designate like parts, a second embodiment of a brick according to the invention is shown in this case, the radius of curvature of the arched walls 114, 114', . . . is less than that of the arched walls 14, 14', of FIG. 1; on the contrary the radius of curvature of the arched walls 115, 115', 116, and 116' is greater than that of the arched walls 15, 15', 16 and 16'. As a result, the brick consisting of the sub-blocks 101, 102, 103 and **101*a* is stronger that that of FIG. 1**.

Further, the longitudinal dimensions of chambers 104–113 are reduced so that the convection is also reduced and then the heat insulating properties are improved.

What is claimed is:

1. A brick preferably made of clay for use in construction, in reinforced concrete and in traditional masonry with a decisive thermal insulating function, which is lightweight, very strong and low in cost, to be used as a self-supporting or sealing or partitioning element, said brick comprising at least one sub-brick (1, 2, 3, or 101, 102, 103, 104);

each sub-brick including a rectangular peripheral outline having a longitudinal axis and a transverse axis, and being subdivided by means of walls (14, 14'; 15, 15'; 16, 16' or 114, 114'; 115, 115'; 116, 116') into vertical air chambers, limited in the direction of the longitudinal axis and extensive in the direction of its transverse axis;

said walls forming cores with a crosssection shaped like the arc of a circle, each arc having a center of curvature;

said walls being arranged alternatively concave and convex in the longitudinal direction of the brick;

the centers of curvature of said arcs being aligned along lines parallel to the longitudinal axis of the brick;

wherein the width (b, c, d, b', c', d') of each chamber, taken along a line in the longitudinal direction, forms alternately longer and shorter line segments from one chamber to the next;

the convex sides of the arcs being longitudinally connected to one another by rectilinear arc septa (17, 18, 19, or 117, 118, 119) of minimum lengt; and sub-bricks (1, 2, 3, or 101, 102, 103, 104) being connected to one another longitudinally by rectilinear sub-brick septa (20, 21, 22, 23 or 120, 121, 122, 123), also of minimum length, wherein said rectilinear sub-brick septa are spaced apart from the peripheral outline of the brick, and are not aligned with the walls of the cores of the adjacent sub-brick.

2. A brick according to claim 1, wherein the rectilinear arc septa connecting the opposite convex walls of the individual chambers (4, 5; 6, 7; 8, 9 or 104, 105; 106, 107; 108, 109) are placed at the break points of the arcs.

3. A brick according to claim 1 wherein it is constructed from a mixture of clay and sansa residue.

4. A brick preferably made of clay, having a substantially rectangular cross section, spaced apart end faces and perpendicular longitudinal and transverse center planes extending between and being perpendicular to the end faces, comprising:

at least two sub-bricks, each having a rectangular cross section, being connected to each other in series in the direction of a longitudinal center plane of the brick, the brick being provided with open air chambers extending between the end faces for providing a thermo-insulating effect;

said sub-bricks being symmetrical with respect to transverse and longitudinal center planes thereof;

a plurality of air chambers provided in each of said sub-bricks, said air chambers being defined by at least one arched web created between a pair of coaxial cylindrical surfaces, said arched webs being arranged in longitudinal rows such that the axes of symmetry of the arched webs are placed along longitudinal planes parallel to and equally spaced apart from a longitudinal center plane of the brick such that each arched web defines a sector of a cylinder having a generally circular cross section;

said air chambers being oriented parallel to the transverse center plane of the brick;

the width of each of said air chambers of each said sub-brick, measured along a plane parallel to the longitudinal center plane of the brick, is such that the width of a central chamber is relatively shorter or longer than the width of the two symmetrical, adjacently disposed chambers;

chambers defined by a pair of cylindrical convex surfaces being provided with longitudinal rectilinear webs connecting the shortest longitudinal distance between opposed pairs of convex surfaces; and relatively short rectilinear longitudinal webs connecting the sub-bricks longitudinally, arranged to be spaced from longitudinal peripheries of the brick and from points in longitudinal alignment with the intersection between arched webs and transverse peripheries of the web bricks.

5. A brick according to claim 1, wherein said brick is constructed from a mixture of clay and sansa granules to provide an alveolar structure throughout the webs subsequent to the baking of the brick, whereby the thermo-insulating effect is enhanced.

* * * * *